US007162774B1

(12) United States Patent
Von Resch et al.

(10) Patent No.: US 7,162,774 B1
(45) Date of Patent: Jan. 16, 2007

(54) MULTI-POSITION ADJUSTABLE DOOR HINGE

(75) Inventors: Julius Von Resch, Stuttgart (DE); Daniel Varin, Brossard (CA)

(73) Assignee: Ferco Architechtural Hardware, Laval (CA)

( * ) Notice: Subject to any disclaimer, the term of this patent is extended or adjusted under 35 U.S.C. 154(b) by 0 days.

(21) Appl. No.: 11/245,186

(22) Filed: Oct. 7, 2005

(51) Int. Cl.
*E05D 7/04* (2006.01)
*E05D 5/00* (2006.01)

(52) U.S. Cl. ..... 16/236; 16/238

(58) Field of Classification Search ..... 16/238–243, 16/386, 312, 248, 233, 380, 261, 263, 264, 16/273
See application file for complete search history.

(56) References Cited

U.S. PATENT DOCUMENTS

| | | | | | |
|---|---|---|---|---|---|
| 801,232 | A * | 10/1905 | Foss | | 16/248 |
| 1,484,536 | A * | 2/1924 | Way | | 16/242 |
| 1,540,581 | A * | 6/1925 | Way | | 16/242 |
| 1,563,869 | A * | 12/1925 | Larson | | 16/243 |
| 1,900,081 | A * | 3/1933 | Swerer | | 16/242 |
| 2,096,311 | A * | 10/1937 | Val Strough | | 16/245 |
| 2,533,502 | A * | 12/1950 | Philips | | 16/242 |
| 2,611,921 | A * | 9/1952 | Weidelstam | | 16/244 |
| 5,755,011 | A * | 5/1998 | Green et al. | | 16/238 |
| 6,212,734 | B1 * | 4/2001 | Commons | | 16/244 |
| 6,397,432 | B1 * | 6/2002 | di Vinadio | | 16/242 |
| 6,484,363 | B1 * | 11/2002 | Chung | | 16/242 |
| 2003/0014838 | A1 * | 1/2003 | deOliveira et al. | | 16/233 |
| 2005/0188499 | A1 * | 9/2005 | Heid | | 16/238 |

FOREIGN PATENT DOCUMENTS

| | | | |
|---|---|---|---|
| DE | 29800600 | U1 * | 4/1998 |
| EP | 259618 | A2 * | 3/1988 |
| EP | 317329 | A1 * | 5/1989 |
| EP | 387207 | A1 * | 9/1990 |
| EP | 616105 | A1 * | 9/1994 |
| GB | 2227521 | A * | 8/1990 |
| GB | 2230557 | A * | 10/1990 |

* cited by examiner

*Primary Examiner*—Robert J. Sandy
*Assistant Examiner*—Andre' L. Jackson
(74) *Attorney, Agent, or Firm*—Ogilvy Renault LLP; Guy J. Houle

(57) ABSTRACT

A multi-position adjustable door hinge is comprised of a frame leaf having a lower barrel section and a door leaf having an upper barrel section. An eccentric pivot pin is disposed in axial rotational fit in a through bore of the lower barrel section and is in contact at a lower end with an adjustment screw. The eccentric pivot pin has an upper cylindrical portion eccentrically displaced from the lower cylindrical portion and extends into a cylindrical bore of an eccentric compensator cylinder adjustably retained in the through bore of the upper barrel section. The eccentric pivot pin and the eccentric compensator cylinder are both axially displaceable from one another whereby to impart relative lateral displacement thereof and of the barrels to a desired position. The adjustment screw at the bottom of the lower barrel section provides vertical adjustment between the frame leaf and the door leaf. Set screws are provided to lock the eccentric pivot pin and the eccentric compensator cylinder at the desired position.

13 Claims, 6 Drawing Sheets

MULTI-POSITION ADJUSTABLE DOOR HINGE

TECHNICAL FIELD

The present invention relates to a multi-position adjustable door hinge having a standard frame leaf and a standard door leaf and wherein the adjustment is effected in the interconnecting joint of the leafs by an eccentric pivot pin and an eccentric compensator cylinder.

BACKGROUND ART

It is known to provide a multi-position adjustable door hinge and wherein one of the leafs is provided with a housing in which there is defined a pocket into which a tongue shaped hinge blade member is inserted. Adjustments between the leafs are provided by adjustment screws which extend into cylinders made integral with the housing. There are usually provided two such screws which are spaced apart and which are in engagement with the tongue shaped hinge blade. In order to mount the leaf which is provided with the housing into a side edge of a door, it is necessary to mortise or route a cavity into the door edge to receive the housing and the projections which protrude from the housing and which accommodate the adjustment screws. This is a time-consuming job and requires precision routing, particularly seeing that there are usually three such adjustable hinges provided on a door frame. Furthermore, in order to effect the adjustment, it is required that the door be open to provide access to the inside face of the leaf containing the housing and this again is a time-consuming job. Because these are special hinges, it is not feasible to install them on an assembly line which installs regular hinges on doors as it requires special machining.

Another disadvantage of the multi-position adjustment hinges as above described is that they are not adapted to replace existing standard hinges which are provided with two leafs, each having screw holes and which connect in standard door mortises. Accordingly, a handyman would find it difficult and time-consuming to replace standard door hinges with these adjustable door hinges.

Another disadvantage of known adjustable door hinges is that if an eccentric pin is used to provide lateral door adjustment by turning the eccentric pin, then this also causes a simultaneous transverse displacement of the door due to the fact that the eccentric of the pin when moving sideways also moves transversely. Therefore, when the door is adjusted in one direction it becomes misaligned in the transverse direction, for example, frontwards if the door is moved sideways. Some of these hinges also do not provide for vertical adjustment of a door as well as a lateral adjustment.

SUMMARY OF INVENTION

It is a feature of the present invention to provide a multi-position adjustable door hinge which substantially overcomes the above-mentioned disadvantages of the prior art.

According to a still further feature of the present invention there is provided a method of adjusting a door in a door frame in the x, y and z axis and which substantially overcomes the above-mentioned disadvantages of the prior art.

Another feature of the present invention is to provide a multi-position adjustable door hinge which is simple in construction, which has standard hinge leafs configuration and does not require further routing of existing hinge leaf mortises.

A still further feature is to provide a multi-position adjustable door hinge which is easy to install, which is economical, easy to repair and which provides micro-adjustments and which cannot be dismantled by thieves.

According to the above features, from a broad aspect, the present invention provides a multi-position adjustable door hinge which comprises a frame leaf having a lower barrel section and a door leaf having an upper barrel section. The lower and upper barrel sections have through bores of circular cross-section. The through bore of the lower barrel section has a threaded lower end portion to receive a vertical axis adjustment screw. An eccentric pivot pin having a lower cylindrical portion is dimensioned for close axial rotational fit in the through bore and is provided in the through bore of the lower barrel section and has a lower end in contact with the adjustment screw. The eccentric pivot pin has an upper cylindrical portion eccentrically displaced from the lower cylindrical portion and extends above the lower barrel section. The lower end of the lower cylindrical portion has a tool engaging cavity therein. The adjustment screw also has tool engaging means to provide for axial rotational displacement thereof. An eccentric compensator cylinder is provided in the through bore of the upper barrel section and has an eccentric cylindrical bore in a lower end thereof for receiving in close rotational fit the upper cylindrical portion of the eccentric pivot pin therein. The eccentric compensator cylinder has an upper tool engaging end for axial rotational displacement thereof. Means is provided to arrest the eccentric pivot pin and the eccentric compensator cylinder at a desired position. The frame leaf and door leaf have screw holes for securing same to a door frame and a door.

According to a further broad aspect of the present invention there is provided a method of adjusting a door in a door frame with the door being provided with the multi-position adjustable door hinges as described hereinabove. The method comprises adjusting the door in a vertical plane with respect to the frame by threading or unthreading the vertical axis adjustment screw. The door is adjusted in a lateral 360° plane by rotational axial displacement of the eccentric pivot pin and the eccentric compensator cylinder to align the door in a side and frontal plane. The eccentric pivot pin and the eccentric compensator cylinder are then arrested by arresting means with the door adjusted to the desired position.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
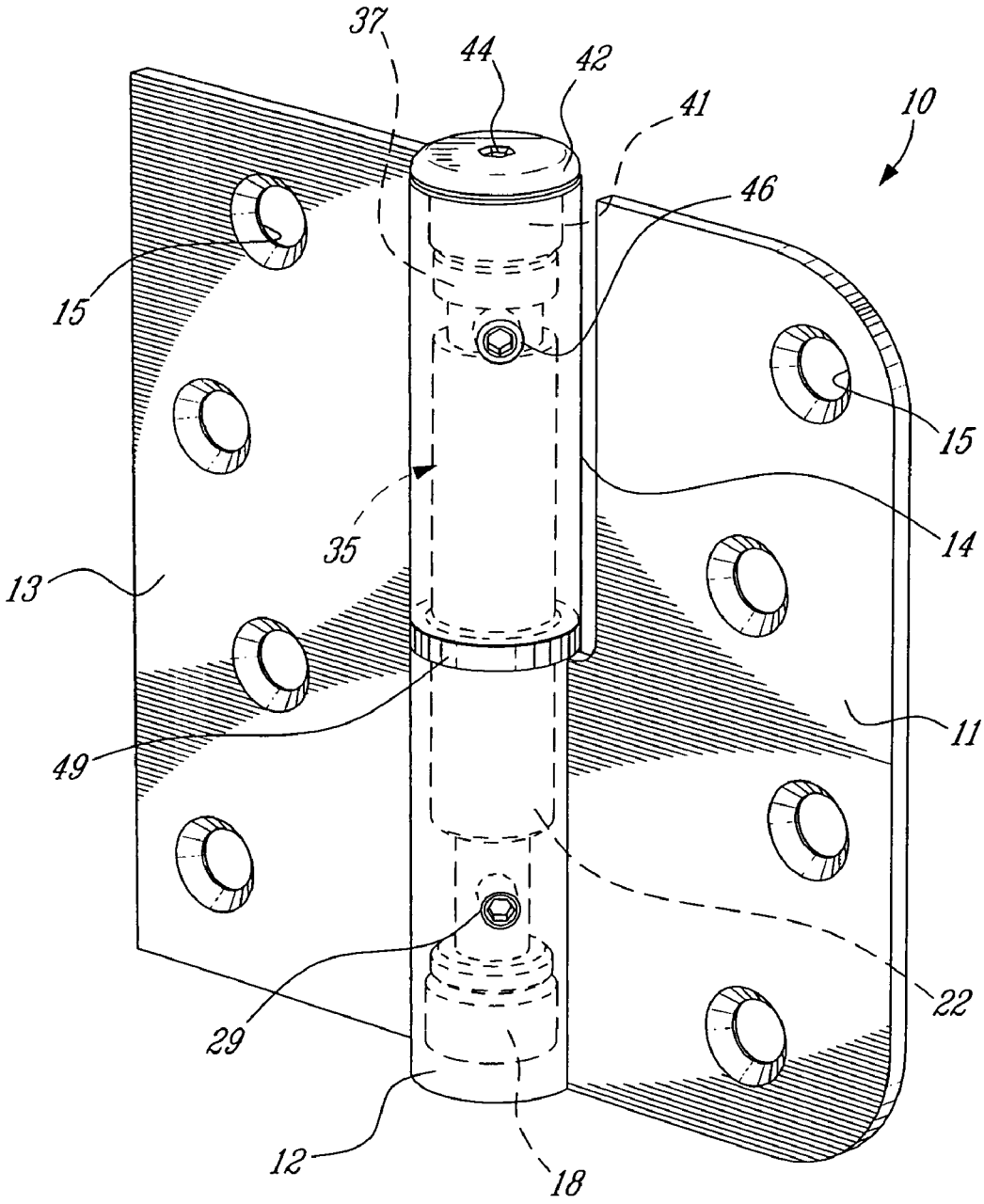
FIG. 1 is a perspective view of the multi-position adjustable door hinge of the present invention fragmented to show its component parts.
Figure 2:
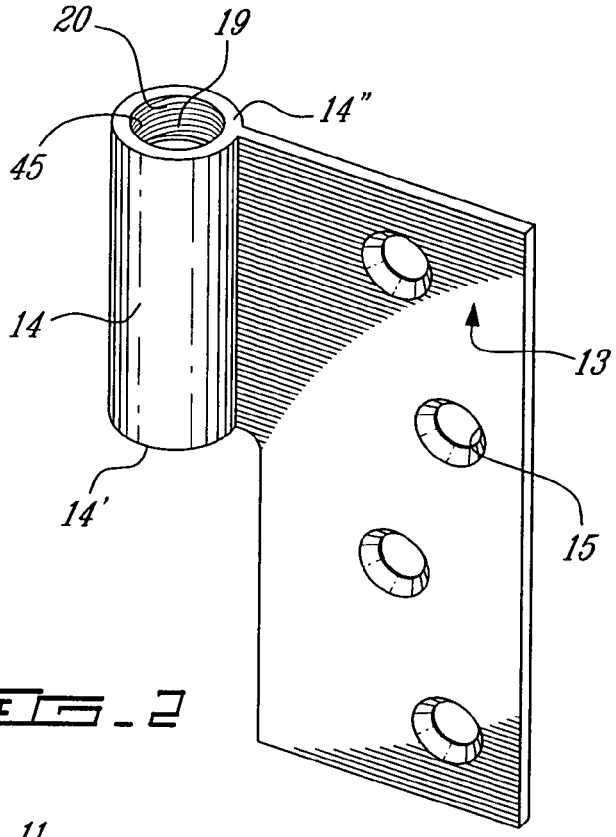
FIG. 2 is a perspective view showing the construction of the door leaf and its upper barrel section.
Figure 3:
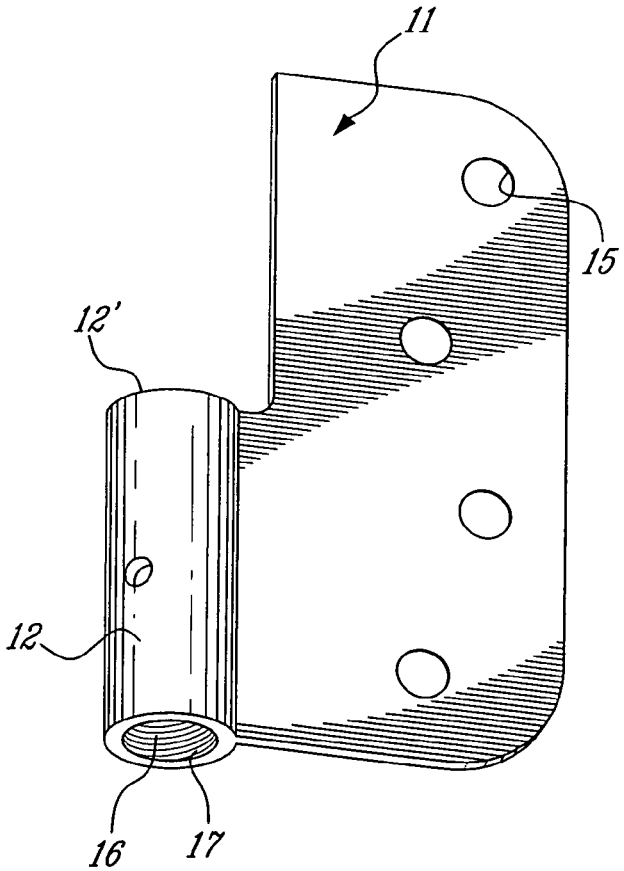
FIG. 3 is a perspective view showing the construction of the frame leaf and its lower barrel section.

Referring now to the drawings, and more particularly to FIGS. 1 to 3, there is shown generally at 10 the multi-position adjustable door hinge of the present invention. It is comprised of a frame leaf 11 which is provided with a lower barrel section 12 and a door leaf 13 which is provided with an upper barrel section 14. Screw holes 15 are provided in these leafs for receiving screws to secure the leafs in respective mortises formed in the side edge of a door and side edge of a frame, as will be described later. The leaf configurations are the same as the configurations of the leafs of a standard door hinge for outside or inside doors.

Figure 4A:
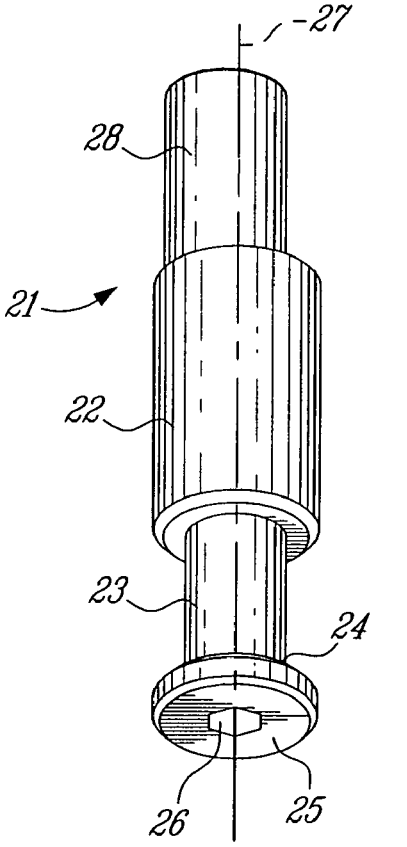
FIG. 4A is a bottom perspective view showing the construction of the eccentric pivot pin.
Figure 4B:
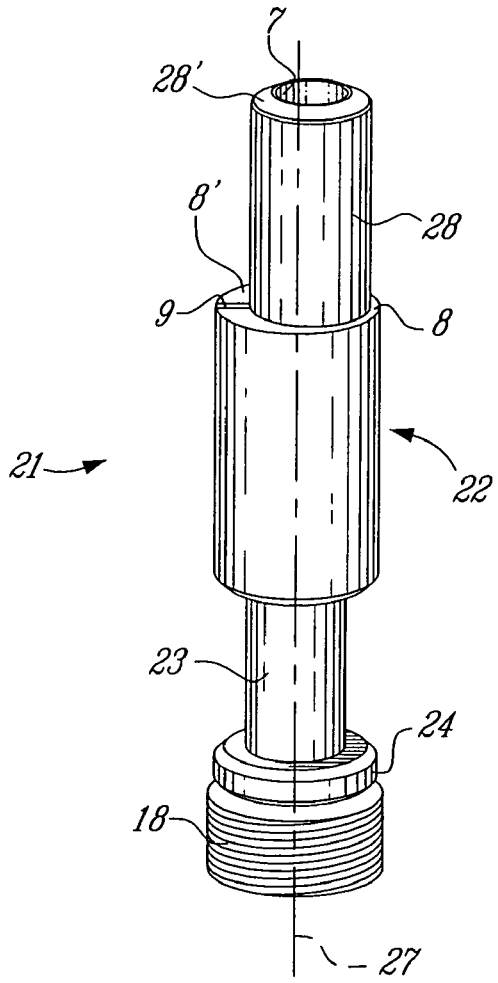
FIG. 4B is a top perspective view showing the construction of the eccentric compensator cylinder sitting on the vertical adjustment screw.

As shown in FIG. 3, the lower barrel section 12 has a through bore 16 which is provided with a threaded lower portion 17 to receive in threaded engagement therewith a vertical axis adjustment screw 18, as shown in FIGS. 1 and 4B.

As shown in FIG. 2, the upper barrel section 14 of the door leaf 13 also defines a through bore 19. The through bore has an upper threaded portion 20 to retain a securing nut 41, as will be described later, to retain a compensator 35.

With reference now to FIGS. 4A and 4B, there is shown an eccentric pivot pin 21 which has a lower cylindrical portion 22 which is of circular cross-section and dimensioned for close axial rotational fit in the through bore 16, from the top end 12' of the lower barrel section 12. The lower cylindrical portion 22 has a lower annular channel 23 of reduced cross-section formed spaced from a lower end thereof and extends to a circular flange 24 at the bottom of the lower cylindrical portion. This flange 24 constitutes the bottom end 25 of the eccentric pivot pin and it sits on top of the vertical axis adjustment screw 18, as shown in FIG. 4B. As shown in FIG. 4A, a tool engaging cavity 26, herein a hexagonal cavity, is formed in the bottom end 25 to receive an Allen key whereby to rotate the eccentric pivot pin 21 along the central vertical axis 27 of the lower cylindrical portion 22. As shown in FIG. 4B, an alignment mark 9 is provided on the surface 8' of the ledge 8 at the top end of the lower cylindrical potion 22. This mark 9 is to provide proper alignment of the parts at fabrication indicating zero setting.

The eccentric pivot pin 21 also has an upper cylindrical portion 28 formed integral therewith and which is eccentrically displaced from the lower cylindrical portion 22. The upper cylindrical portion 28 is dimensioned whereby to extend above the top end 12' of the lower barrel section 12 of the frame leaf. The eccentric pivot pin 21 is retained within the lower barrel section 12 by a set screw 29 (see FIGS. 1 and 7) which also provides an arresting means to lock the lower cylindrical portion 22 with the lower barrel section 12. This set screw 29 extends into the lower section 23 of the eccentric pivot pin 21 which is of reduced cross-section thereby preventing the pin from moving out of the lower barrel section 12. The set screw 29 is accessible from the inside of a door. This prevents the pin 29 from being removed from outside the door when the door is shut whereby to remove the pivot pin 21.

Figure 6:
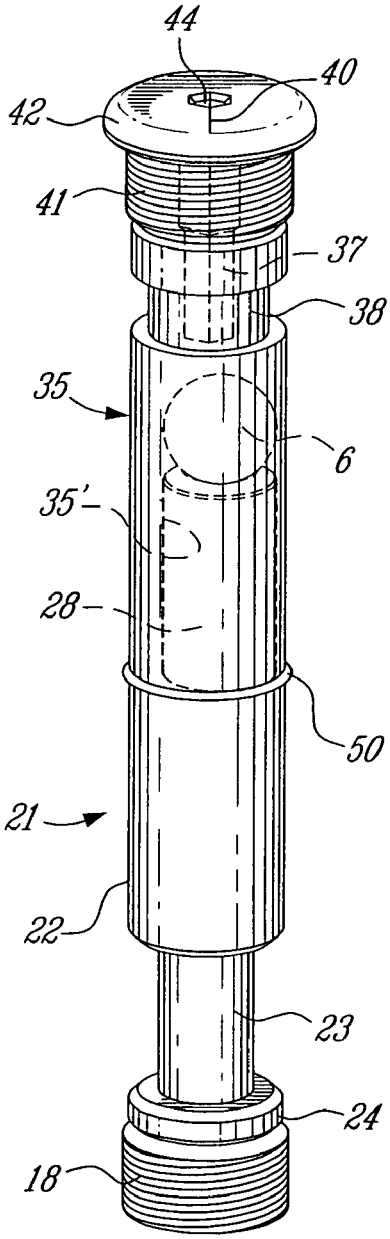
FIG. 6 is a perspective view showing the assembly of the pivot pin and the compensator cylinder at their zero setting.

The top end 28' of the upper cylindrical portion 28 has a ball bearing seating cavity 7 whereby to receive a pivoting ball bearing 6 as shown in FIG. 6. The ball bearing 6 is retained captive within the eccentric compensator cylinder 35 which will now be described.

Figure 5:
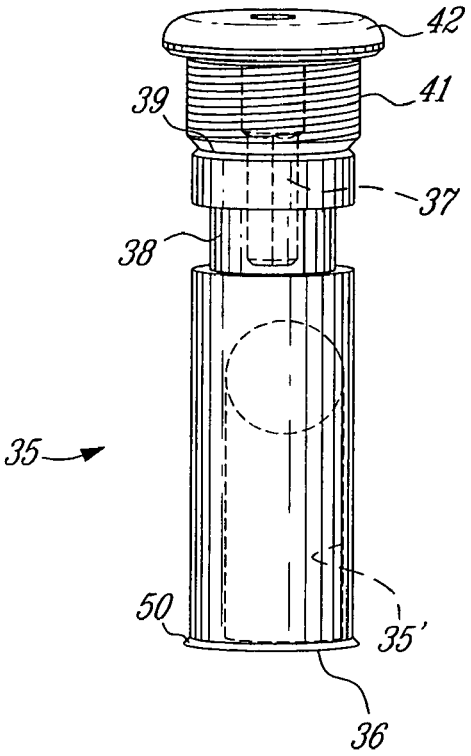
FIG. 5 is a perspective side view of the compensator cylinder with the securing nut and cap shown in position on the top thereof.
Figure 7:
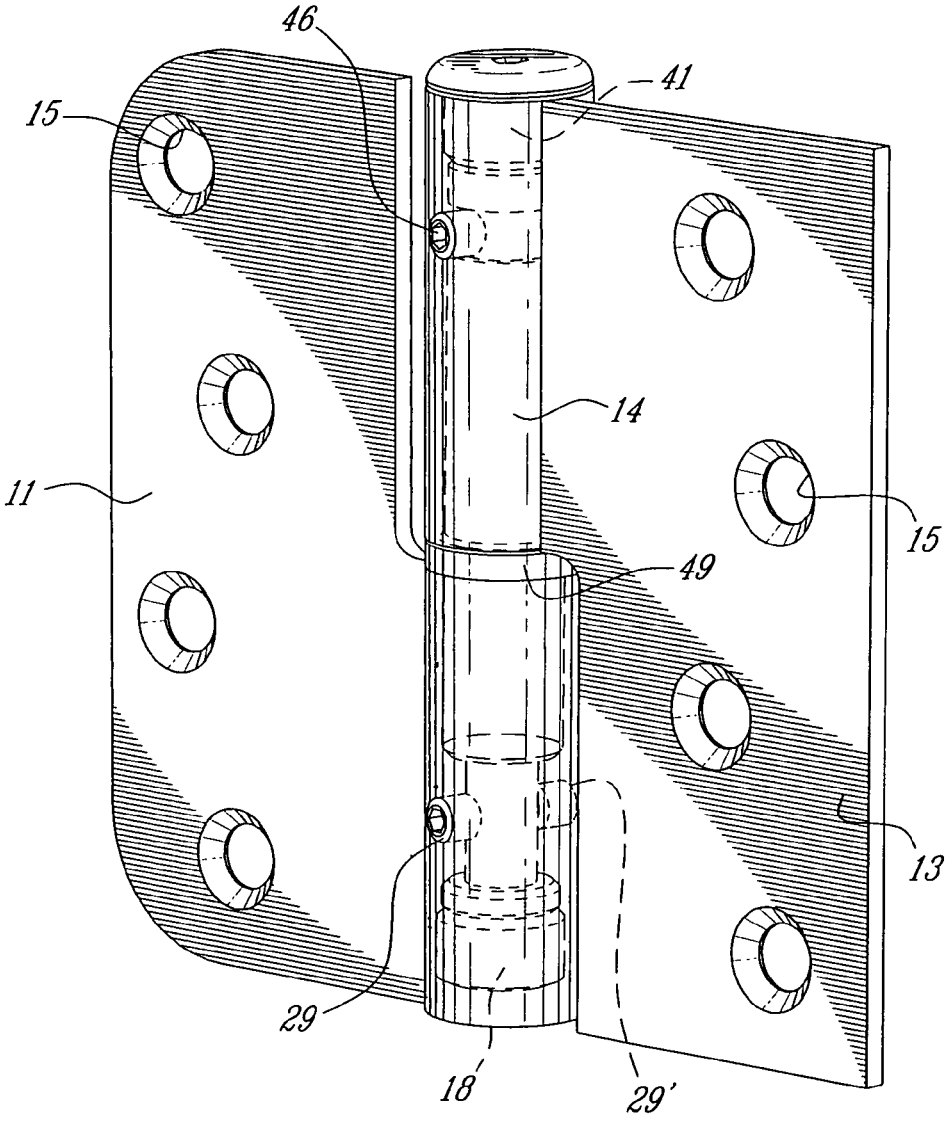
FIG. 7 is a perspective view similar to FIG. 1 illustrating the position of the set screws.

Referring now to FIGS. 5 and 6, there is shown the construction of an eccentric compensator cylinder 35 which is disposed in the through bore 19 of the upper barrel section 14 from the bottom end 14' thereof. This eccentric compensator cylinder has an eccentric cylindrical bore 35' at a bottom end 36 thereof for receiving in close rotational fit therein the upper cylindrical portion 28 of the eccentric pivot pin 21. The eccentric compensator cylinder 35 has an upper tool engaging cavity 37 to permit axial rotational displacement of the eccentric compensator cylinder. This upper tool engaging cavity 37 is a hexagonal cavity to receive a connecting pin 43 of like cross-section of an adjustment cap 42, see FIG. 8. An annular channel 38 is formed spaced from the top end 39 of the cylinder 35 to receive a set screw 46 (see FIGS. 1 and 7). As shown in FIGS. 1, 5 and 7, the compensator cylinder 35 is retained in the upper barrel 14 by a securing nut 41.

Figure 8:
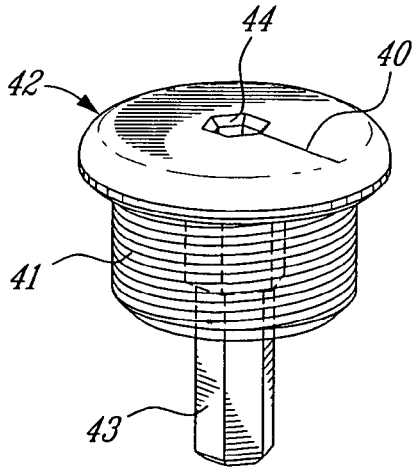
FIG. 8 is a perspective view of the adjustable cap and the top securing nut which retains the compensator cylinder in the top barrel.

Referring to FIG. 8 there is shown an adjustment cap 42 sitting on the securing nut 41 which is in threaded engagement with the upper threaded portion 20 of the upper barrel section of the door leaf 13 as previously described. The adjustment cap 42 is provided with hexagonal connecting pin 43, formed integral therewith, projects thereunder and through the nut 41. A hexagonal cavity 44 is formed in the cap 42 to receive an Allen key to rotate the pin 43 which is press fitted into the cavity 37 in the top end of the compensator cylinder 35 to rotate the cylinder. An alignment mark 40 is formed on the top surface of the cap 42 for alignment of the parts at fabrication. The set screw 46 provides an arresting means for the eccentric compensator cylinder and is disposed in a side wall of the upper barrel section 14 and projects through the upper barrel section to contact the eccentric compensator cylinder 35 in the channel 38 to immovably secure same to the upper barrel section 14 at a set position by the adjustment cap 42.

Figure 9:
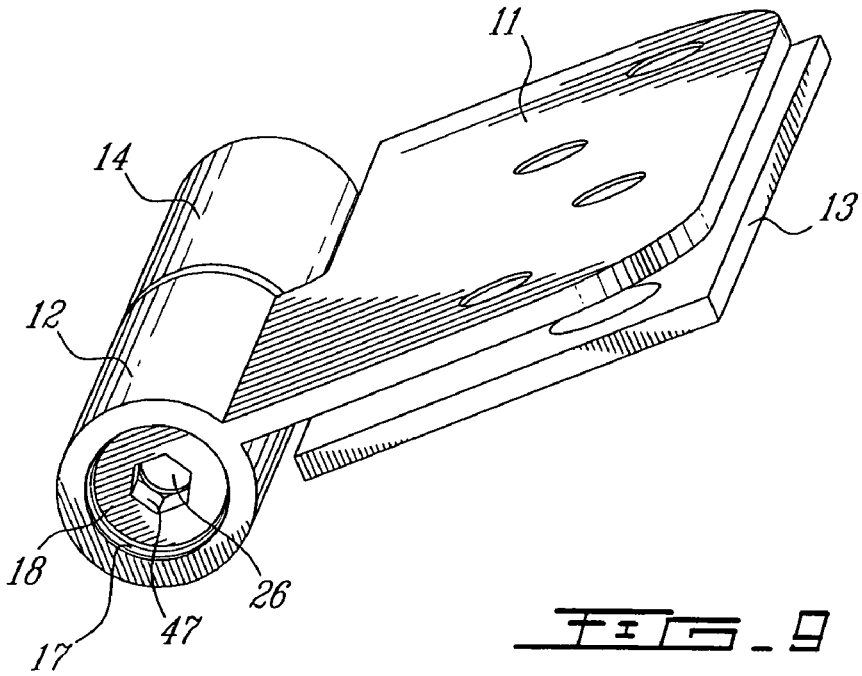
FIG. 9 is a bottom perspective view of the leafs assembled showing the position and the relationship of the vertical axis adjustment screw and the pivot pin lower tool engaging cavity.

As shown in FIG. 9, the vertical axis adjustment screw 18 is a hollow screw having a hexagonal bore 47 which is of a diameter larger than the tool engaging cavity 26 at the bottom end of the eccentric pivot pin 21 to permit the passage of an Allen key through the vertical axis adjustment screw 18. Also, the through bore 47 of the vertical axis adjustment screw 18 is in the form of a hexagon cavity whereby to receive therein a much larger Allen key to cause the screw to move up and down in the bottom end of the lower barrel section 12 to provide vertical displacement of the eccentric pivot pin 21 and accordingly displacement between the door leaf 13 and the frame leaf 11 to provide relative vertical displacement of the door with respect to the frame. When the hinge is vertically adjusted a gap is created between the top end 12' of the lower barrel section 12 and the bottom end 14' of the upper barrel section 14. In order to conceal the pin portion extending through that gap there is provided a pin concealing snap ring 49 (see FIGS. 1 and 7) and the thickness of this ring is selected to substantially conceal the gap after the hinge leafs have been adjusted relative to one another.

As shown in FIG. 5, the lower end of the eccentric compensator cylinder is provided with a circumferential skirt 50 projecting outwardly thereof and this skirt projects under the lower edge 14' of the upper barrel section 14 and retained captive thereby so that the eccentric compensator cylinder cannot be pushed out of the through bore of the upper barrel section 14 by a thief trying to dismantle the hinge joint between the frame leaf and the door leaf.

Figure 10:
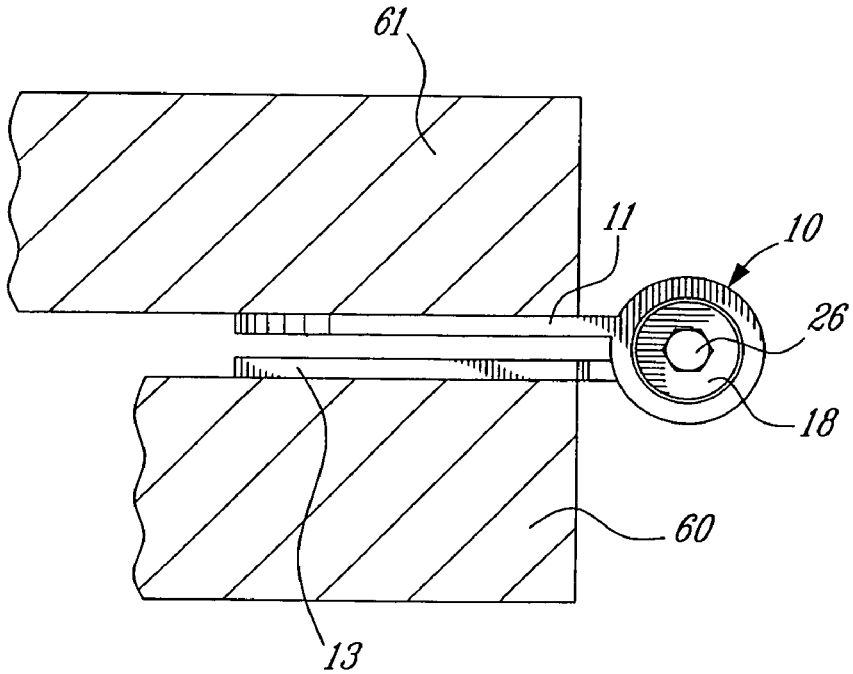
FIG. 10 is a top view showing the mounting of the multi-position adjustable door hinge to a door frame and a door shown in section.

Having thus described the construction of the multi-position adjustable door hinge 10 of the present invention, FIG. 10 shows the hinge 10 secured between a door 60 and a door frame 61. It can be seen, from FIGS. 1 and 7, that vertical adjustment between the frame leaf 11 and the door leaf 13 is provided by the vertical adjustment screw 18 which is accessible at a lower end of the lower barrel section 12. By threading or unthreading the screw 18, the door 60 connected to the door leaf 13 will be displaced upwardly or downwardly from the frame leaf 11 connected to the frame 61. With this particular design a door can be adjusted within a distance of 5 mm, upwardly 2 mm and downwardly 3 mm.

In order to provide lateral displacement of the door 60 with respect to the frame 61, the tool engaging cavity 26 of the eccentric pivot pin 21 (see FIG. 9) is engaged by an Allen key extending through the vertical axis adjustment screw 18 and rotated. This causes the upper cylindrical eccentric portion 28 of the eccentric pivot pin to rotate eccentrically about the central pivot axis 27 of the lower cylindrical portion 22 causing an outward displacement of the compensator cylinder 35 and consequently the door leaf 13 with respect to the frame leaf 11. Because this eccentric cylindrical portion 28 causes lateral displacement it also causes frontal displacement and this may not be desirable. Therefore, in order to compensate for this frontal displacement, the tool engaging cavity 37 of the eccentric compensator cylinder is also engaged by an Allen key from the top end of the upper barrel section 14 through the cap 42. This will bring back the door within the frame to a desired position. Therefore, with two Allen keys engaged at each end of the hinge joint, any desirable micro-adjustment within a 360° plane is achievable. Accordingly, the multi-position adjustable door hinge of the present invention is adjustable along an x, y and z axis at any desirable angle in the x and y plane. Once the door has been adjusted to a desirable position by the adjustment of its hinges, the eccentric pivot pin and the eccentric compensator cylinders are locked at their desired position by the set screws 29, 29' and 46, respectively.

It is within the ambit of the present invention to cover any obvious modifications of the preferred embodiment described herein, provided such modifications fall within the scope of the appended claims.

The invention claimed is:

1. A multi-position adjustable door hinge comprising a frame leaf having a lower barrel section and a door leaf having an upper barrel section, said lower and upper barrel sections having through bores of circular cross-section, said through bore of said lower barrel section having a threaded lower end portion receiving a vertical axis adjustment screw in threaded engagement therewith, an eccentric pivot pin having a lower cylindrical portion dimensioned for close 360° axial rotational fit in said through bore of said lower barrel section and having a lower end in contact with said adjustment screw, said eccentric pivot pin having an upper cylindrical portion eccentrically displaced from said lower cylindrical portion and extending above said lower barrel section, said lower end having a tool engaging cavity therein receiving a tool to cause axial rotation of said eccentric pivot pin and thereby lateral displacement between said frame leaf and door leaf, said adjustment screw having tool engaging means to provide for axial rotational displacement thereof to cause said eccentric pivot pin to displace vertically in said through bore to provide vertical displacement between said frame leaf and door leaf, an eccentric compensator cylinder in said through bore of said upper barrel section and having an eccentric cylindrical bore in a lower end thereof for receiving said upper cylindrical portion of said eccentric pin in close rotational fit therein, said eccentric compensator cylinder having an upper tool engaging end permitting axial rotational displacement thereof about 360° whereby providing transversal displacement between said frame leaf and door leaf, and means to arrest said eccentric pivot pin and said eccentric compensator cylinder at a desired position; said adjustable door hinge providing precise adjustment of said lateral displacement, said vertical displacement and said transversal displacement without dismantling said adjustable door hinge; said frame leaf and door leaf having screw holes for securing same to a door frame and a door.

2. A multi-position adjustable door hinge as claimed in claim 1 wherein there is further provided a ball bearing retained captive in said cylindrical bore between a seat of said cylindrical bore and a seating cavity of said upper cylindrical portion.

3. A multi-position adjustable door hinge as claimed in claim 1 wherein said means to arrest said eccentric compensator cylinder is provided by a locking set screw threaded into said upper barrel and projecting into an annular channel formed about said eccentric compensator cylinder and spaced from an upper end thereof.

4. A multi-position adjustable door hinge as claimed in claim 1 wherein said means to arrest said eccentric pivot pin is provided by a locking set screw threaded into said lower barrel and projecting into a lower annular channel spaced from a lower end of said eccentric pivot pin.

5. A multi-position adjustable-door hinge as claimed in claim 1 wherein there is further provided a pin concealing snap ring interposed about said eccentric pivot pin and between adjacent ends of said lower and upper barrels, said snap ring having a thickness selected to substantially conceal a gap between said adjacent ends of said barrels after vertical adjustment of said vertical axis adjustment screw.

6. A multi-position adjustable door hinge as claimed in claim 1 wherein said eccentric pivot pin and said eccentric compensator cylinder provide for lateral adjustment between said frame leaf and door leaf to any position about a 360° plane.

7. A multi-position adjustable door hinge as claimed in claim 1 wherein said eccentric compensator cylinder has a circumferential skirt projecting about a lower end thereof, said skirt projecting under a lower edge of said upper barrel section and retained captive thereby.

8. A multi-position adjustable door hinge as claimed in claim 1 wherein said adjustment screw is a hollow adjustment screw to provide access to said tool engaging cavity.

9. A multi-position adjustable door hinge as claimed in claim 8 wherein said tool engaging means is a hexagonal through bore having a diameter dimensioned to permit passage of an Allen key for access to said tool engaging cavity at said lower end of said pivot pin.

10. A multi-position adjustable door hinge as claimed in claim 9 wherein said hexagonal through bore is engageable by an Allen key.

11. A multi-position adjustable door hinge as claimed in claim 1 wherein said upper tool engaging end is connectible by an adjustment cap having a connecting pin engaged in an upper end of said eccentric compensator cylinder, said cap having a tool formation for rotating same, said cap being seated on a top end of said upper barrel.

12. A multi-position adjustable door hinge as claimed in claim 1 wherein said tool formation is a hexagonal central cavity in said adjustment cap for engagement by an Allen key.

13. A multi-position adjustable door hinge as claimed in claim 11 wherein said cap is provided with an alignment mark on a top surface thereof for alignment with a further alignment mark on a ledge at a top end of said lower cylindrical portion of said pivot pin for precise alignment of said eccentric compensator cylinder with said pivot pin at fabrication indicating zero setting.

* * * * *